United States Patent [19]

Cederbaum

[11] 4,385,678

[45] May 31, 1983

[54] SILENT-RUNNING INTERNAL COMBUSTION MOTOR POWER UNIT

[76] Inventor: Jerzy H. Cederbaum, Sorterargatan 14-16, 162 26 Vällingby, Sweden

[21] Appl. No.: 253,340

[22] Filed: Aug. 19, 1980

Related U.S. Application Data

[63] Continuation of Ser. No. 22,566, Feb. 23, 1979, abandoned.

[51] Int. Cl.[3] ..... F01N 1/10

[52] U.S. Cl. ..... 181/204

[58] Field of Search ..... 181/200, 202, 204, 224, 181/264, 265, 269, 271, 275, 198

[56] References Cited

U.S. PATENT DOCUMENTS

| | | | |
|---|---|---|---|
| 3,478,958 | 11/1969 | Hinck et al. | 181/200 |
| 3,642,092 | 2/1972 | Cederbaum | 181/204 |
| 4,071,009 | 1/1978 | Karina | 181/204 |
| 4,120,376 | 10/1978 | Palmer | 181/204 |

FOREIGN PATENT DOCUMENTS

| | | |
|---|---|---|
| 1208482 | 2/1960 | France . |
| 1521057 | 4/1968 | France . |
| 309499 | 3/1969 | Sweden . |
| 326841 | 8/1970 | Sweden . |
| 328306 | 9/1970 | Sweden . |
| 328307 | 9/1970 | Sweden . |
| 369543 | 9/1974 | Sweden . |
| 372794 | 1/1975 | Sweden . |
| 640740 | 7/1950 | United Kingdom . |

*Primary Examiner*—Benjamin R. Fuller

*Attorney, Agent, or Firm*—Sughrue, Mion, Zinn, Macpeak & Seas

[57] ABSTRACT

A silent-running motor power unit with an internal combustion motor (3) enclosed in a sound absorption chamber formed by a casing, having at least two walls (24, 22*a*, 23) arranged one (24) inside the other (22*a*, 23). The walls form part of a labyrinthine channel (6, 1) lined with sound absorption material. To make access and service to the motor (3) easy said walls (22*a*, 23, 24) include inner (24) and outer (22*a*, 23) door sections hinged at one of their ends whereat an inner section (24) may be swung outwards through the opening of an outer section (22*a*, 23). This is achieved by making the sections as a smaller part of a channel wall and as a light plane wall section instead of previously used heavy channel volume type sections.

1 Claim, 3 Drawing Figures

SILENT-RUNNING INTERNAL COMBUSTION MOTOR POWER UNIT

This is a Continuation, of application Ser. No. 22,566, filed Feb. 23, 1979 now abandoned.

The invention relates to a silent-running motor power unit, the actual internal combustion motor unit being enclosed in a sound absorption chamber formed by a casing, the side casing parts of which, which consist of at least two walls, one inside the other, form at least inlets for cooling air and/or air of combustion for the motor unit and possibly also outlets for exhaust air, the which inlets and possibly also outlets for outgoing sound waves constitute labyrinthine channels listed with absorption material, in which the sound waves lose their sound effect through several changes of direction.

Such silent-running motor power units are known with the walls of their side casing parts so arranged that they can be moved aside to render the unit accessible for inspection. In such case, however, the entire side casing part structure, divided into sections, has been made openable so as to render the motor power unit accessible for inspection and service. Such devices have, however, been relatively difficult to handle, bulky and, owing to the weight of the large openable elements, also readily subject to damage.

The object of the present invention is to produce a more flexible and easily handled device, with which faults cannot so easily occur, and consisting essentially in the fact that the wall or door elements of the side casing parts are individually hinged in such a way that, when an outer door element has been opened, a corresponding inner door element in the labyrinthine channel can also be opened and thus run clear of the outer door element.

To achieve this according to one embodiment of the invention the bearing axes of the inner door elements are displaced in relation to the bearing axes of the other door elements in a direction perpendicular to these axes. It is appropriate in such case that the inner and the outer door elements are hinged in the opposing end-walls or posts of the sound absorption chamber.

Figure 1:
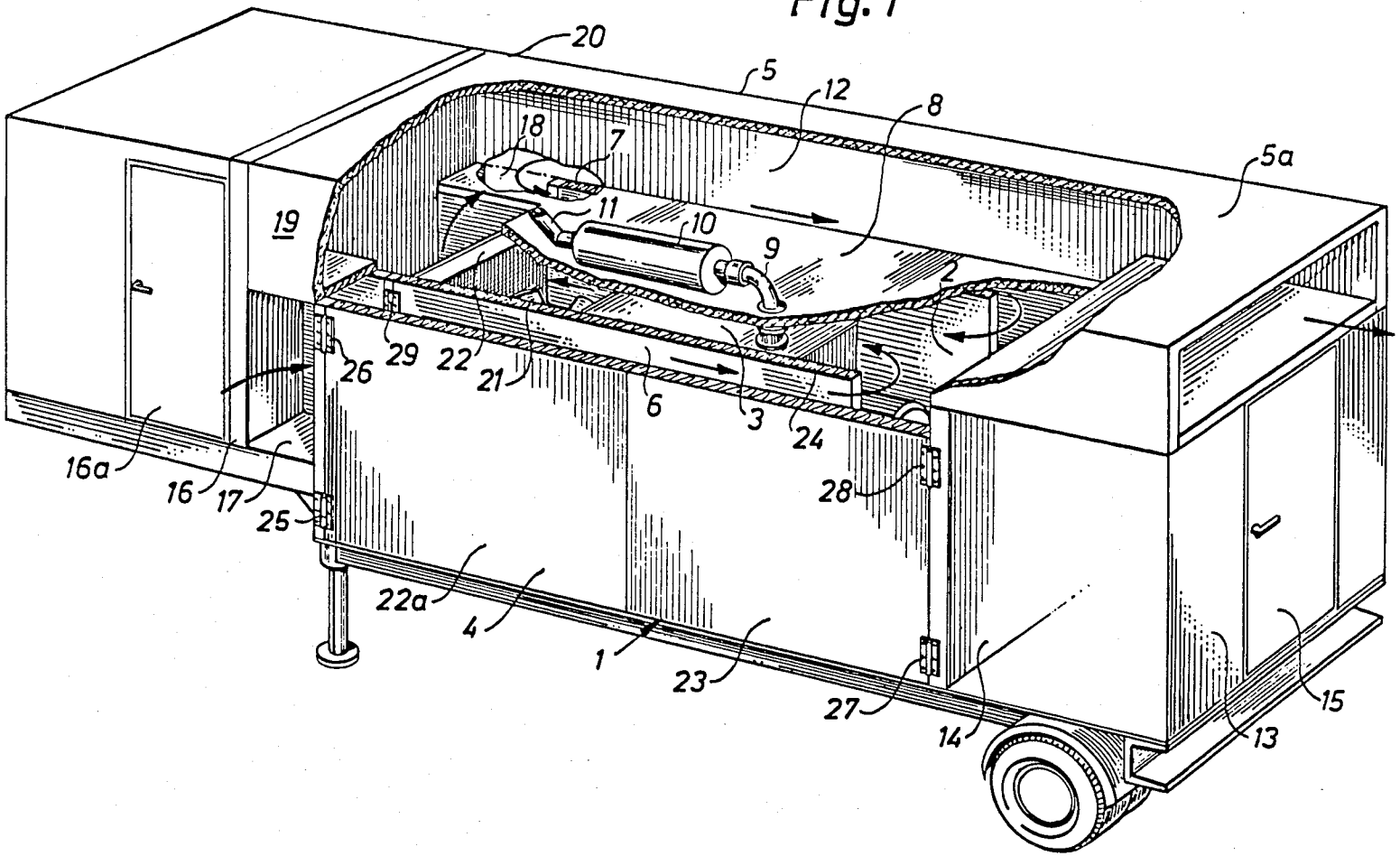
Figure 2:
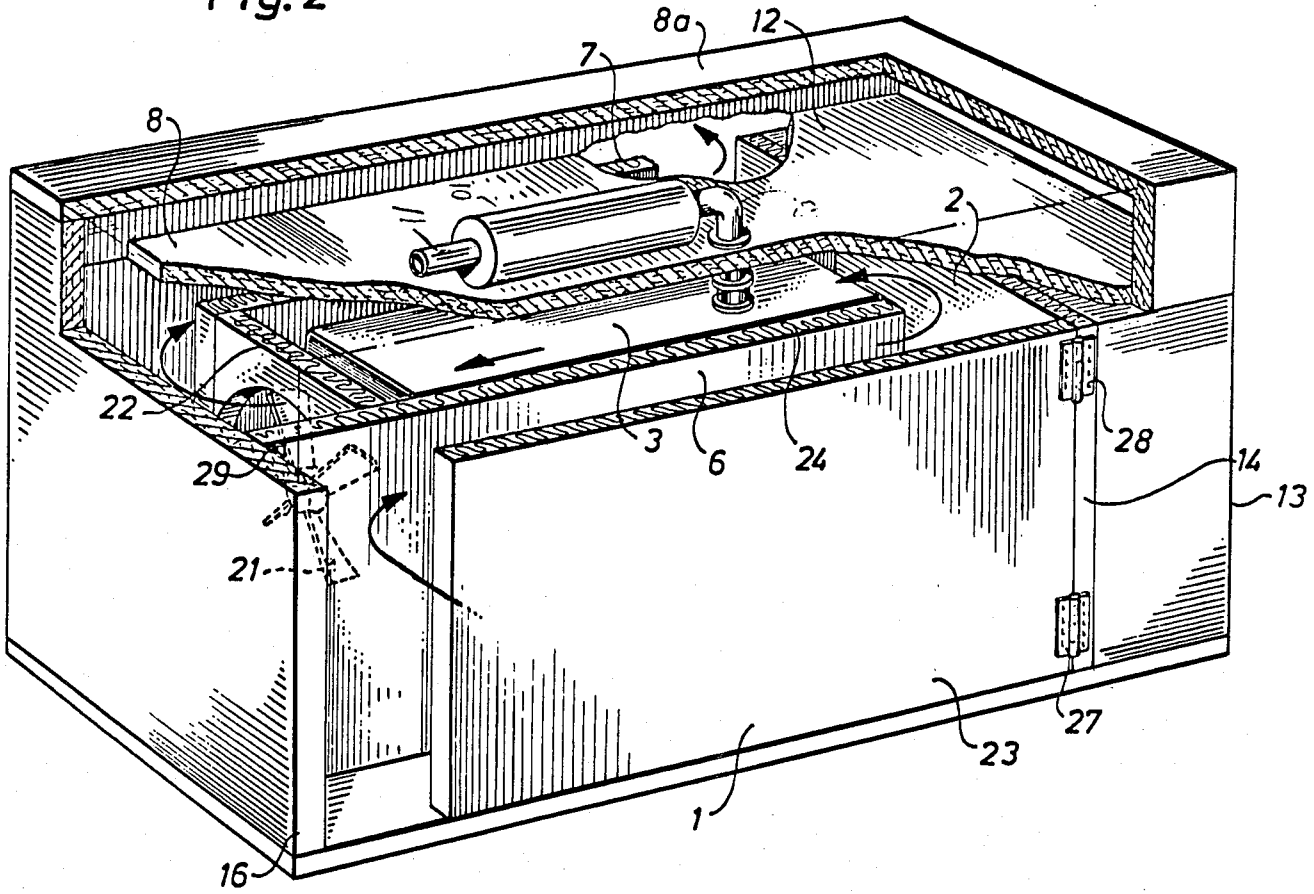
Figure 3:
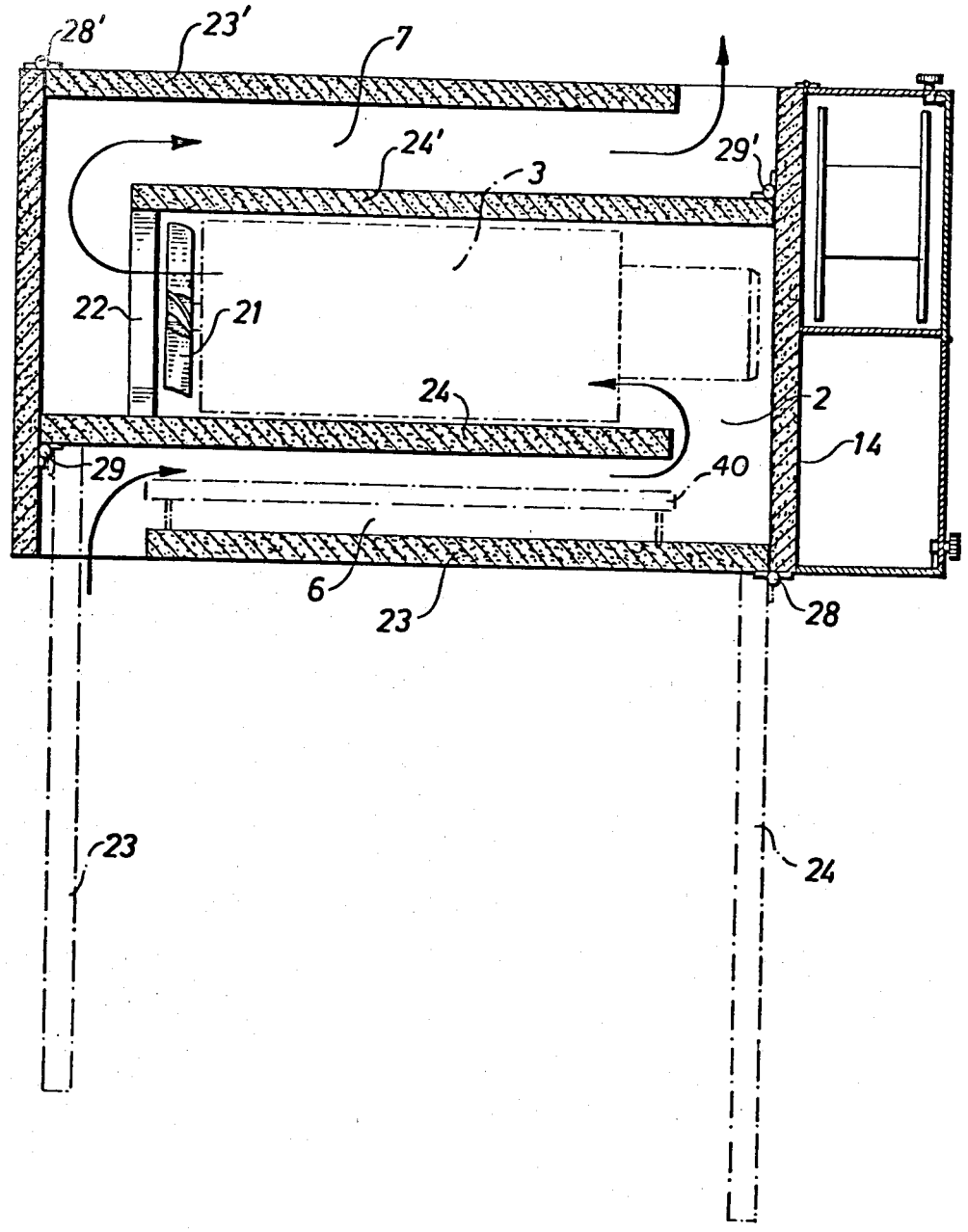

The invention will now be described with reference to the attached drawings, of which FIG. 1 shows one embodiment of the invention in which the sound absorption chamber has air intakes in both side casing parts and the outlet is formed by a channel on the upper side of the sound absorption chamber, which channel emerges in one end-wall of the sound absorption chamber, while FIG. 2 shows another embodiment of the invention with the inlet arranged in one side casing part of the absorption chamber and the outlet in the other side casing part, and FIG. 3 shows a section of the embodiment of FIG. 2 in which the inlet labyrinthine channel is longitudinally divided by means of an extra longitudinal absorption wall.

In FIG. 1 is shown a silent-running internal combustion motor power unit in the form of a trailer 1 which in its central portion contains a sound absorption chamber 2, in the centre of which is a motor unit 3. The sound absorption chamber is laterally bounded by side casing parts 4, 5 containing inlet labyrinthine channels 6, 7. At the top the sound absorption chamber is bounded by a ceiling 8 through which the exhaust pipe 9 of the power unit passes up to the silencer 10. From the latter the exhaust gases pass through a pipe 11 into an outlet channel 12 formed between the ceiling 8 and overlying roof 8*a* and emerging in the rear end-wall 13 of the power unit. Between said end-wall 13 and the corresponding end-wall 14 of the sound absorption chamber there is a switchgear for the unit, a small service room for the same, and a tool bench or the like. Access to the service room is through the end-door 15. At the front end-wall 16 of the motor power unit there are spaces for cable reels or the like for the unit's connecting cable. Access to these spaces is through a sidedoor 16*a*.

As appears from FIG. 1, in the embodiment shown, inlets 17, 18 are placed in walls 19, 20 of the side casing parts. These inlets emerge into sound absorption channels 6, 7 and the in-flowing air passes, as shown by arrows, first into the two sound absorption channels 6, 7 in the direction of the arrows from the front 16 towards the rear 14 end-wall, thereafter into the sound absorption chamber 2 through openings in the inner walls of the sound absorption channels 6, 7 as shown by the curved arrows. The air then flows along the motor power unit 3, through a compression fan 21, the radiator 22 and, as shown by the upward pointing arrow, upwards to the outlet channel 12 above the sound absorption chamber 2. The used air together with the exhaust gases then emerge in the rear end-wall 13 as indicated by the arrow there.

As appears from FIG. 1, the side casing walls contain two outer wall doors 22*a*, 23 and an inner wall door 24. The outer wall door 22 is mounted on hinges 25, 26 placed on a post near the front end-wall 16 of the unit, while door 23 is mounted on hinges 27, 28 on the rear end-wall 14 of the sound absorption chamber 2.

The inner wall door 24 is mounted on two hinges, of which the upper 29 is seen in FIG. 1. These two hinges, as is seen are displaced towards the rear end-wall 14 of the sound absorption chamber 2 so far that the door 24, after doors 22, 23 have been opened, can also be opened without being obstructed by the outer doors.

The arrangements are the same in the other side casing of sound absorption chamber 2.

In the embodiment of the invention shown in FIG. 2, for the sake of simplicity only the actual absorption chamber 2 and its outer walls are shown. In this embodiment as well the entire sound absorption casing is denoted by 1, the outer wall door of the side casing parts by 23, and the inner wall door by 24. The sound absorption chamber is denoted by 2, the motor power unit by 3, the compression fan by 21, the radiator by 22, the exhaust pipe by 9, the silencer by 10, and the outlet pipe by 11, while the ceiling of the sound absorption chamber has been denoted by 8 and its roof by 8*a*, and the rear end-wall by 14. The outer side-wall of the other side casing part has been denoted by 7 and the inlet opening by 17.

In this embodiment fresh air is admitted through the inlet opening 17 as shown by the arrow. The air then passes through the sound absorption channel 6, round the inner side-wall 24 of the side casing, as shown by the curved arrow, flows longitudinally along the unit up to the compression fan 21, passes the radiator 22 and then branches into an air-stream up to the upper outlet channel 12 and out to the outlet in the end-wall 14, and into another air-stream, as shown by the curved arrow beside the front end-wall 16, into the sound absorption channel 7 in the other side casing and out through an opening in the side-wall, as marked by a curved arrow.

In this embodiment the wall doors 23, 24 in the side casing parts are mounted, the former (i.e. door 23), at the rear end-wall 14 of the sound absorption chamber, on hinges 27, 28, while the inner side-wall 24 is mounted at the front end-wall 16 on two hinges, the upper 29 of which is glimpsed in the figure. The wall doors of the other side casing, which form channel 7, are similarly mounted. As is apparent from the two embodiments described, the invention provides a very simple, sure and convenient form of handling of the side-walls of the sound absorption channels to obtain access to the motor power unit 3 without risk of damage to the hinges in the side-walls.

FIG. 3 shows a cross-section of the embodiment shown in FIG. 2, in which an extra longitudinal sound absorption wall 40 has been introduced in one 6 of the sound absorption channels. Otherwise the notations in FIG. 3 are the same as in FIG. 2. By means of dash-dot lines it has been indicated how the two side-walls 23, 24 can be entirely opened out to allow inspection of the motor power unit 3.

Although the invention has been described with reference to two of its embodiments, it can be arbitrarily varied within the scope of the following claims.

I claim:

1. A sound absorption chamber device for a silent-running motor power unit, comprising a casing having at least one inlet and one outlet for cooling air and/or air of combustion for a motor unit, said casing containing labyrinthine air passages formed by side, top and bottom walls lined with acoustic absorption material, at least one side wall comprising an inner side wall and outer side wall, said inner side wall being situated inside said, outer side wall, each of said inner and outer side walls limiting a part of an air passage and having at least one portion in the form of a panel or door which is horizontally movable in relation to said portion of the other one of the inner and outer side walls and other moving portions of the casing so as to form side wall portions which are horizontally movable inside one another, said inner and outer side wall portions being displaceable without obstructing one another and being operable to expose an opening from the space outside the power unit through the side walls into the motor unit to make it accessible for servicing, said inner and outer side wall portions being pivotable about a joint at a side edge thereof, said inner side wall portion having vertical pivoting axis being displaced from a vertical pivoting axis of said outer side wall portion in a direction perpendicular to said axes, such that the inner side wall portion is unobstructed when displaced, and a fan being arranged to create an airflow through the inlet passage, a motor power compartment, a radiator of the motor power unit and the outlet passage, respectively, wherein an air intake of the motor unit is arranged in said airflow upstream of said radiator.

* * * * *